US007770503B2

(12) United States Patent
de Almeida

(10) Patent No.: US 7,770,503 B2
(45) Date of Patent: Aug. 10, 2010

(54) EQUIPMENT FOR RECHARGE OF CARTRIDGES, RECHARGE METHOD AND RECHARGED CARTRIDGES

(76) Inventor: Celestino Goncalves Missa de Almeida, Rua Manoel Elias da Castro, 1465 - Nações, Campina Grande, PB (BR) 58102-526

( * ) Notice: Subject to any disclaimer, the term of this patent is extended or adjusted under 35 U.S.C. 154(b) by 0 days.

(21) Appl. No.: 12/280,489

(22) PCT Filed: Feb. 23, 2007

(86) PCT No.: PCT/BR2007/000050

§ 371 (c)(1),
(2), (4) Date: Aug. 22, 2008

(87) PCT Pub. No.: WO2007/095714

PCT Pub. Date: Aug. 30, 2007

(65) Prior Publication Data

US 2009/0013859 A1 Jan. 15, 2009

(30) Foreign Application Priority Data

Feb. 23, 2006 (BR) ..... 0601973

(51) Int. Cl.
*F42B 33/02* (2006.01)

(52) U.S. Cl. ..... 86/25; 86/28; 86/31; 86/24

(58) Field of Classification Search ..... 86/23, 86/25, 28, 31, 24
See application file for complete search history.

(56) References Cited

U.S. PATENT DOCUMENTS

| | | | | |
|---|---|---|---|---|
| 2,413,094 | A | 12/1946 | Yost | |
| 3,857,319 | A | 12/1974 | Welch | |
| 5,313,869 | A * | 5/1994 | Lee | 86/25 |
| 5,900,574 | A * | 5/1999 | Hart | 86/43 |
| 6,772,668 | B2 * | 8/2004 | Shields | 86/31 |
| 7,497,155 | B2 * | 3/2009 | Koskela | 86/45 |

* cited by examiner

*Primary Examiner*—J. Woodrow Eldred
(74) *Attorney, Agent, or Firm*—Volpe and Koenig, P.C.

(57) ABSTRACT

The present invention refers to equipment, for the recharging firearm cartridges, having four modules that can operate jointly or separately. The equipment includes a calibrating press, that calibrates and removes a deflagrated fuse of the case through the movement of the piston tool ports and a washing turbine having a rotating nucleus that moves angularly between 90 and −90 degrees to facilitate loading, washing and discharging of the cases. The equipment also includes a fuse press for fuse assembly in the case, with automatic rejection of the defective cases through pneumatic auxiliary cylinders of high sensitivity. The press includes a case feeder system; a rotating disk; and a reservoir feeder of fuses. The press also includes a dosage press for the assembly and packing of the cartridges, with movements synchronized vertically, circular and lineal, with main cylinder and commanded by panel provided with commands for control of the gunpowder dosage.

18 Claims, 14 Drawing Sheets

EQUIPMENT FOR RECHARGE OF CARTRIDGES, RECHARGE METHOD AND RECHARGED CARTRIDGES

Figure 1:
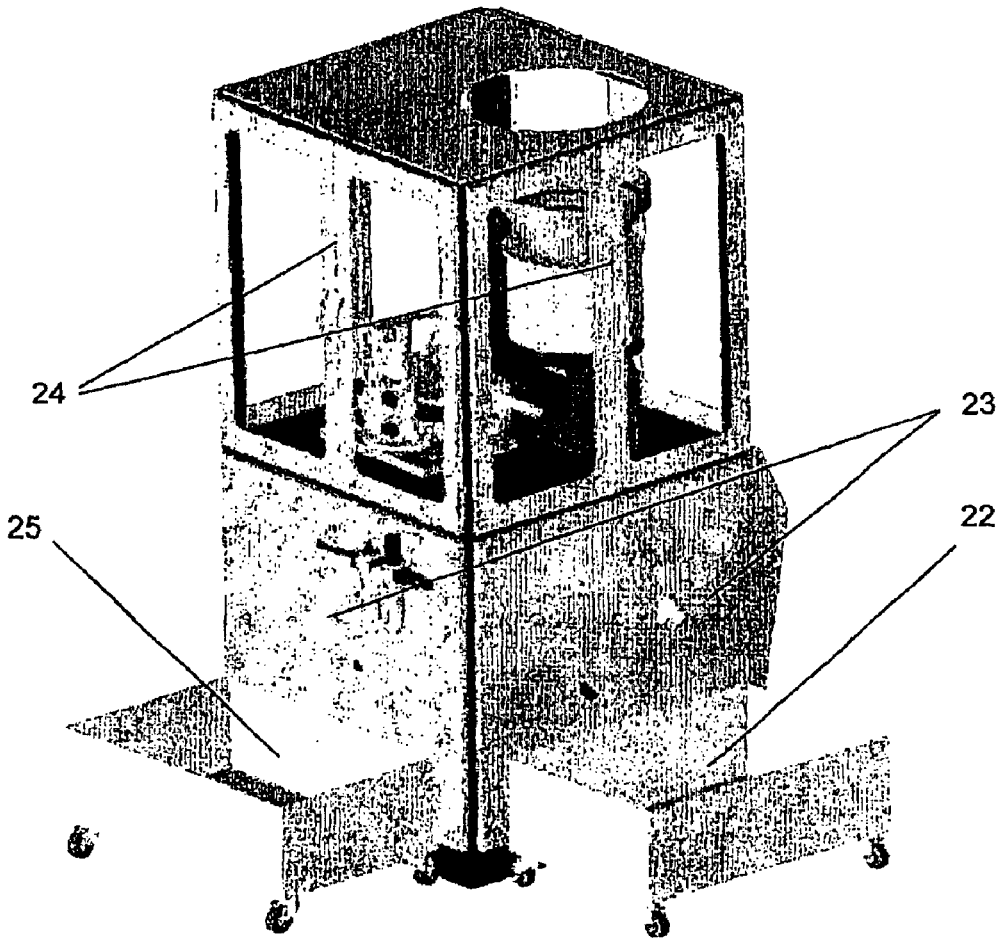
Figure 2:
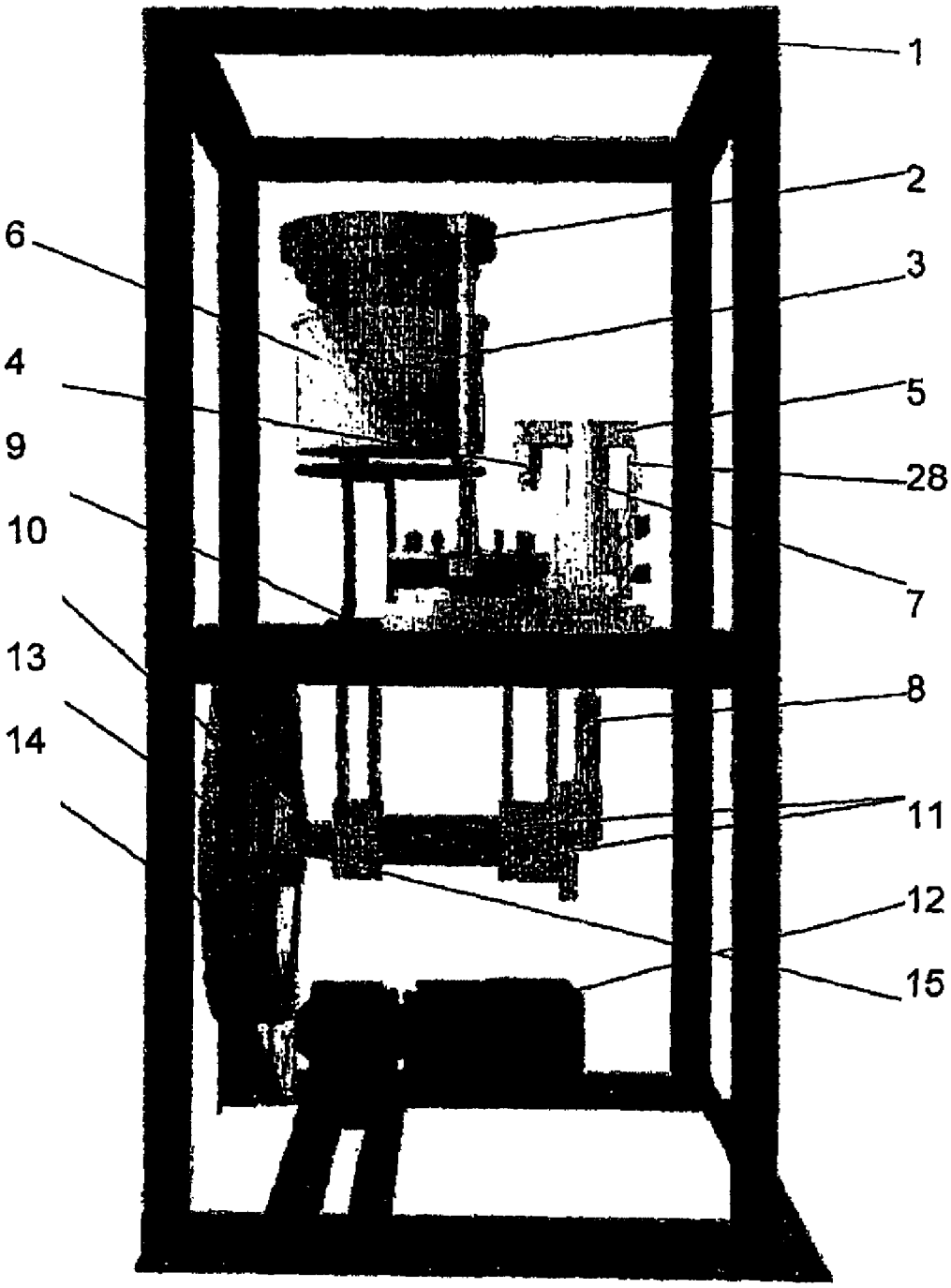
Figure 3:
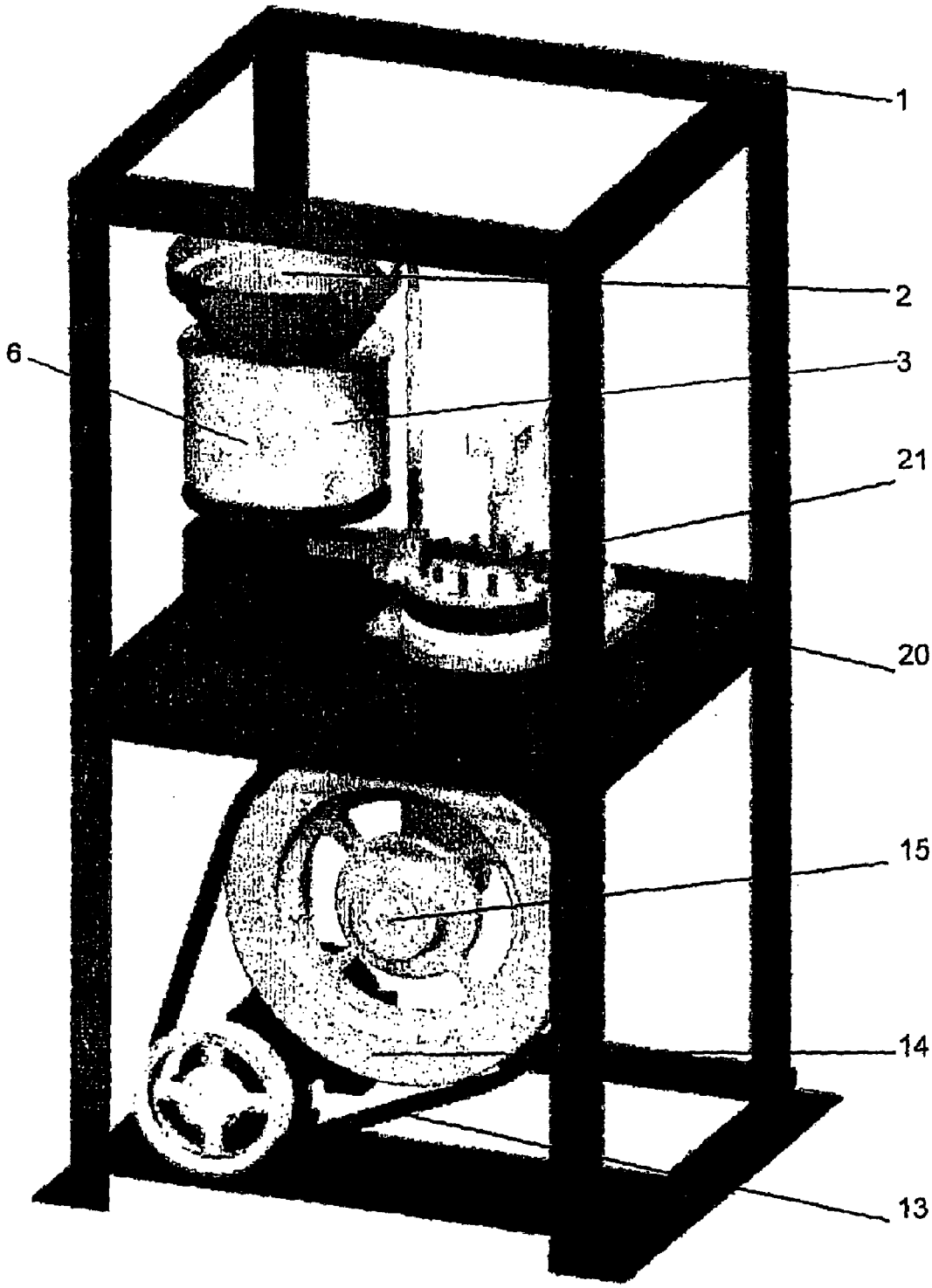
Figure 4:
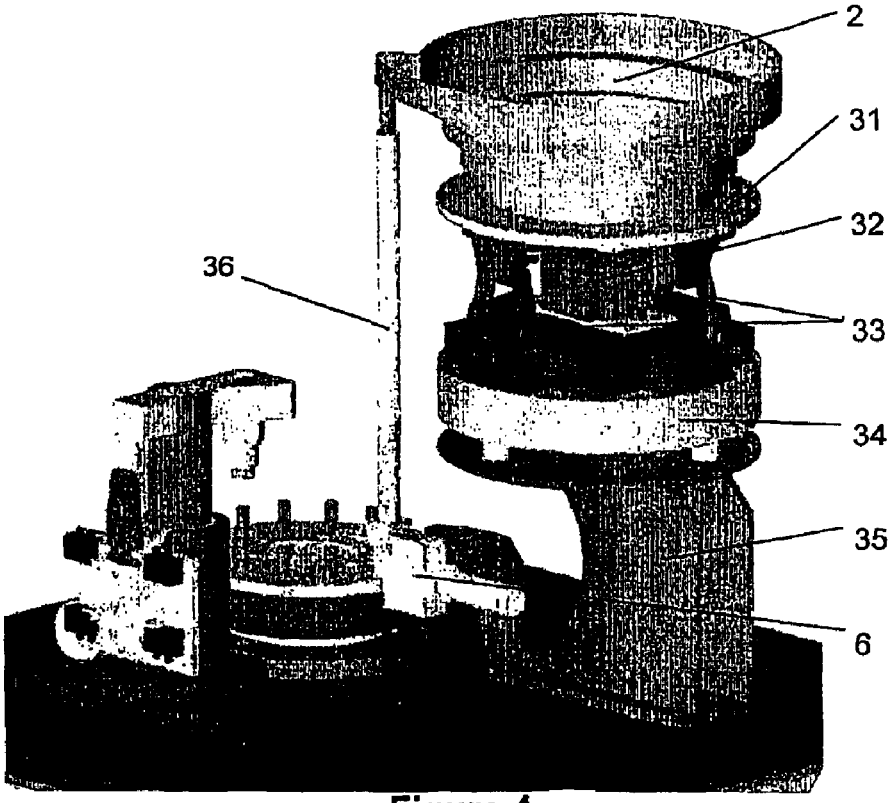
Figure 5:
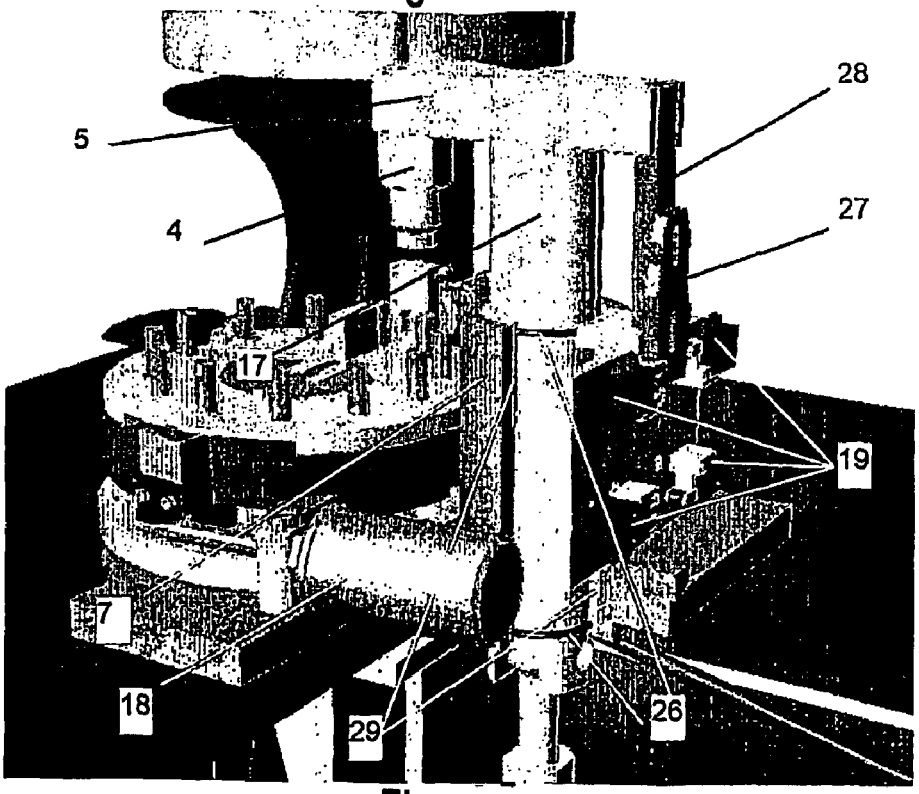
Figure 6:
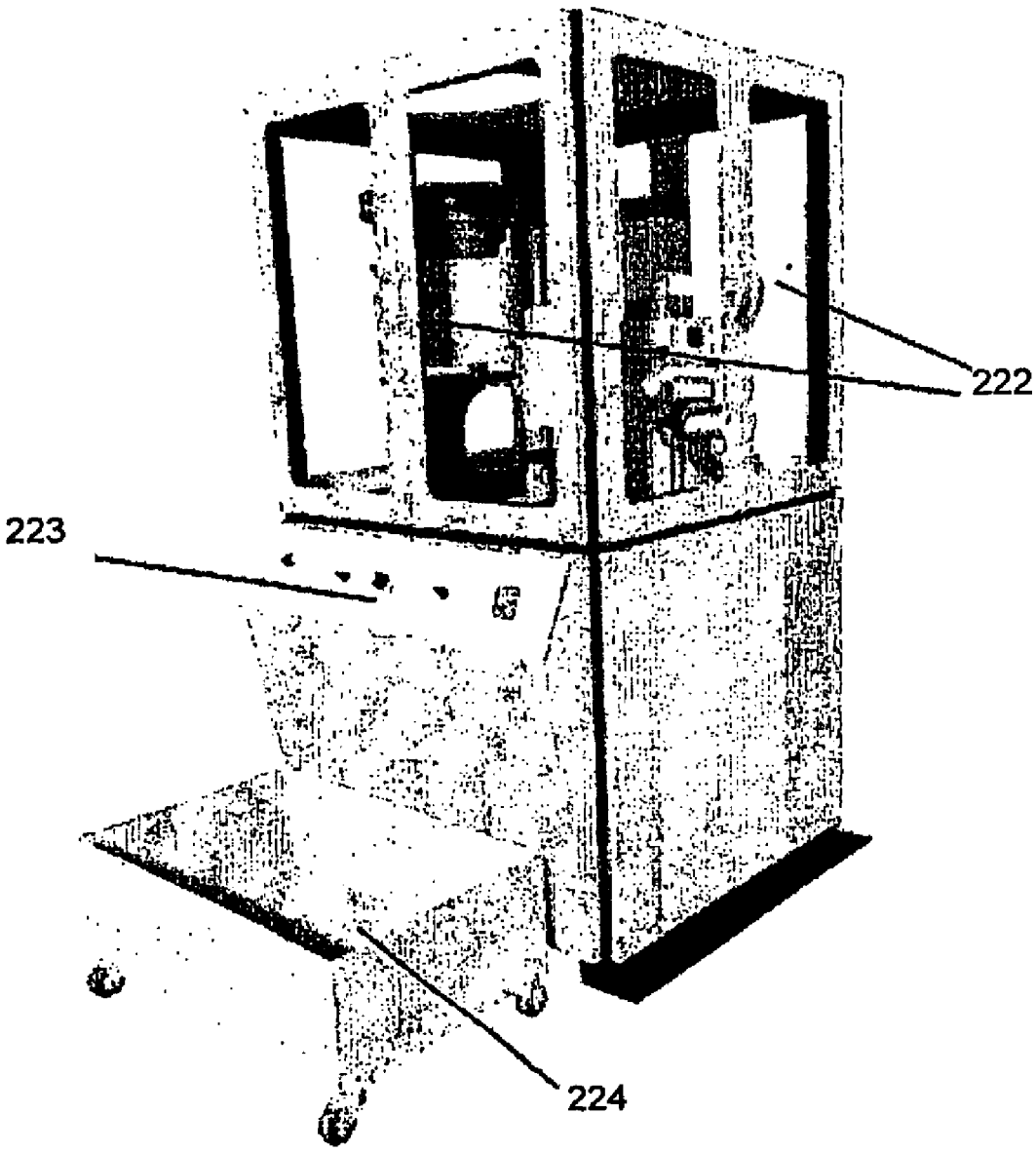
Figure 7:
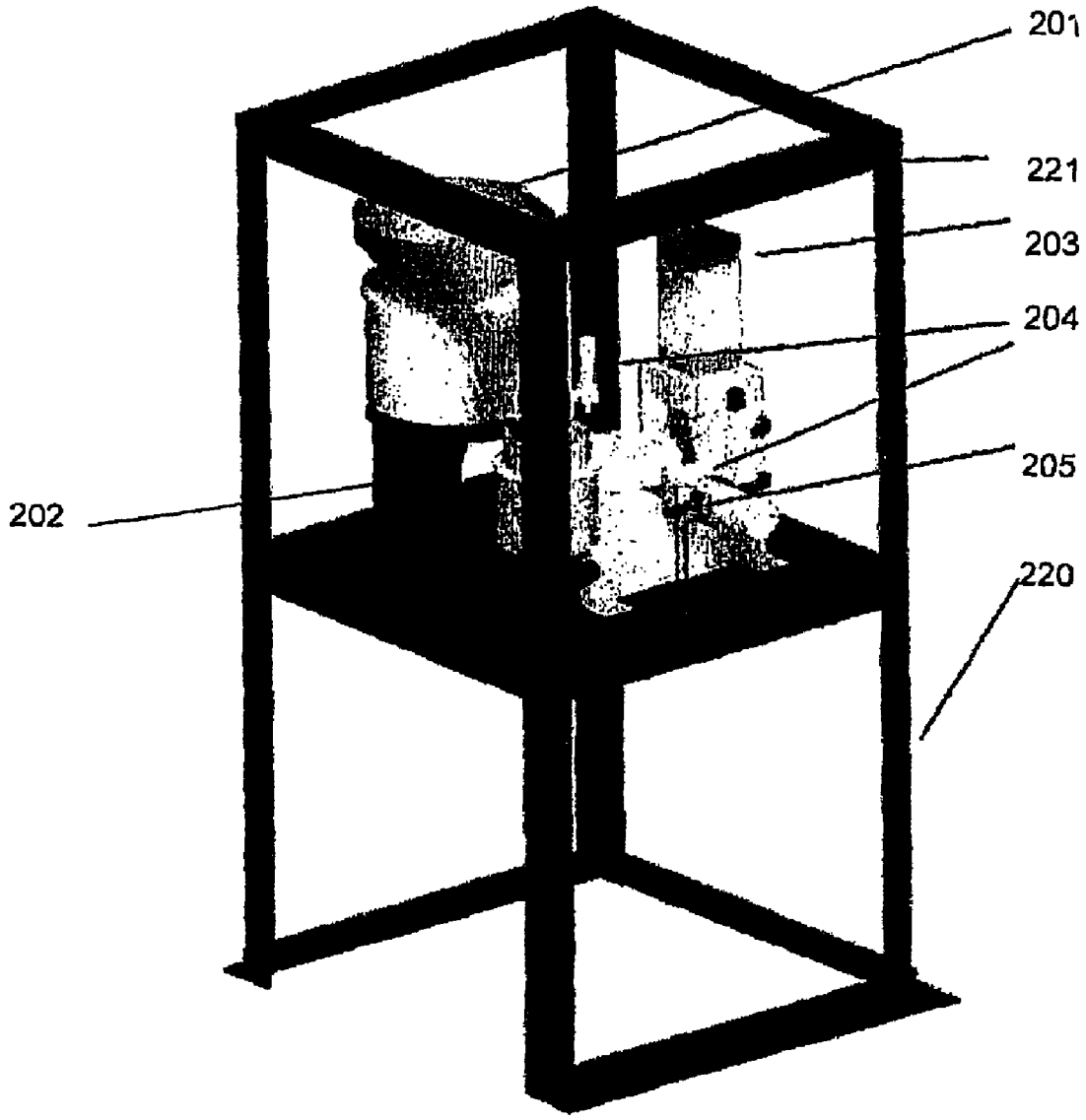
Figure 8:
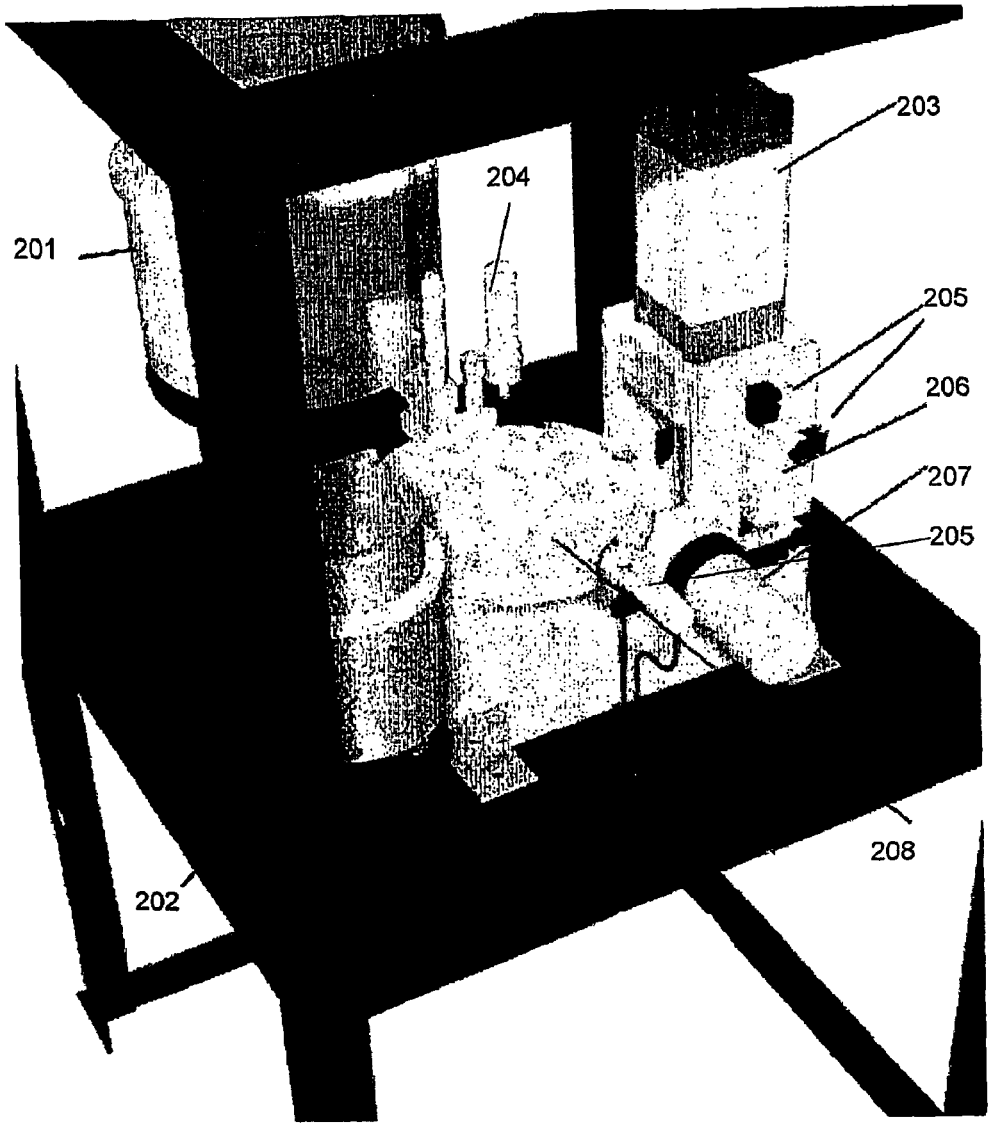
Figure 9:
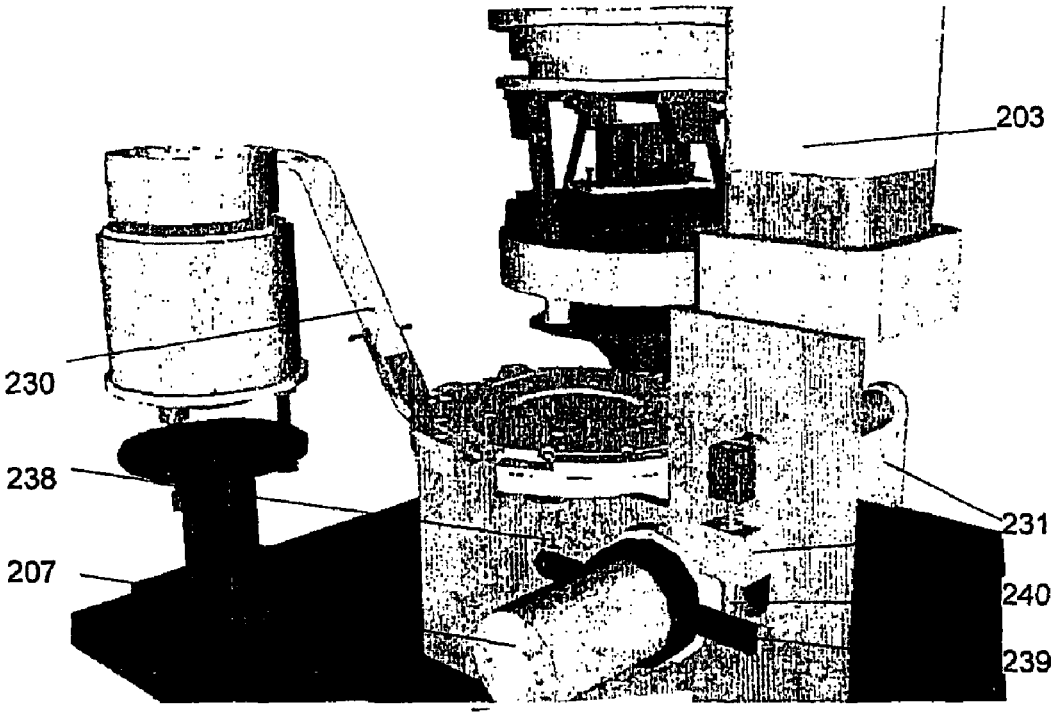
Figure 10:
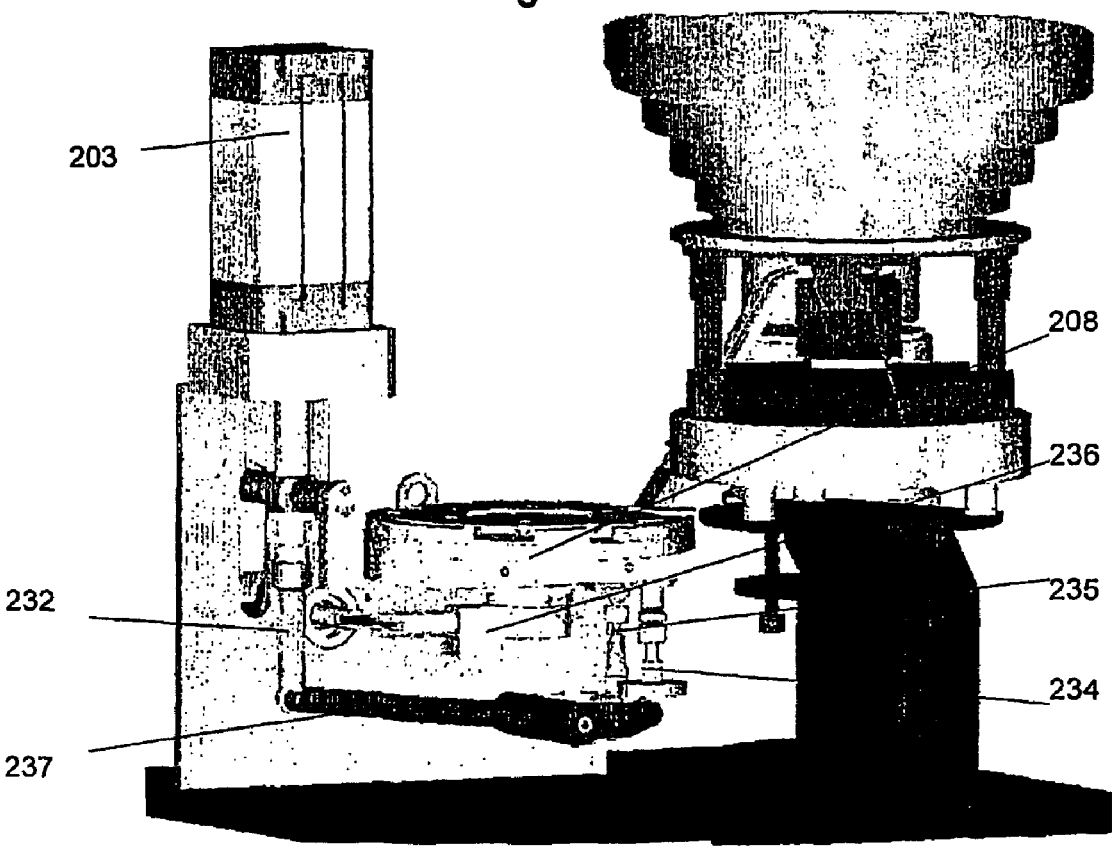
Figure 11:
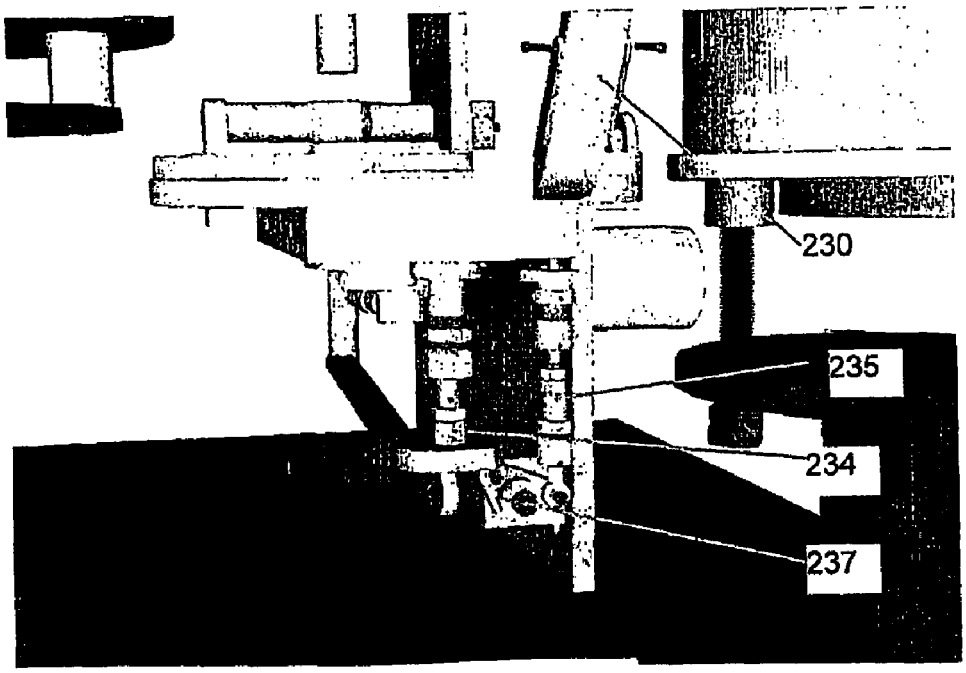
Figure 12:
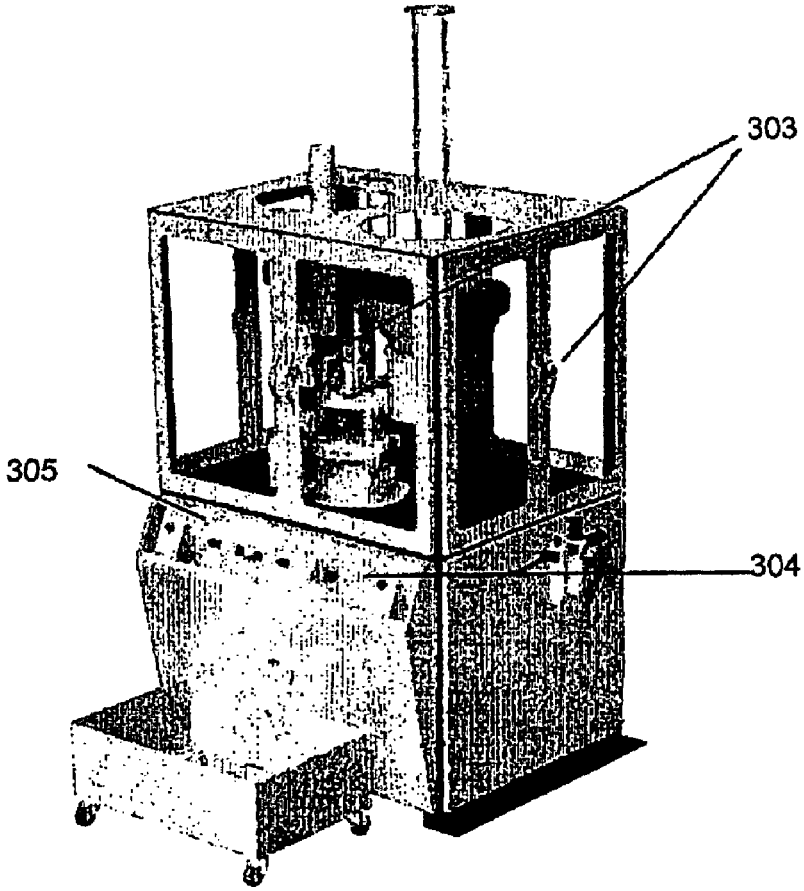
Figure 13:
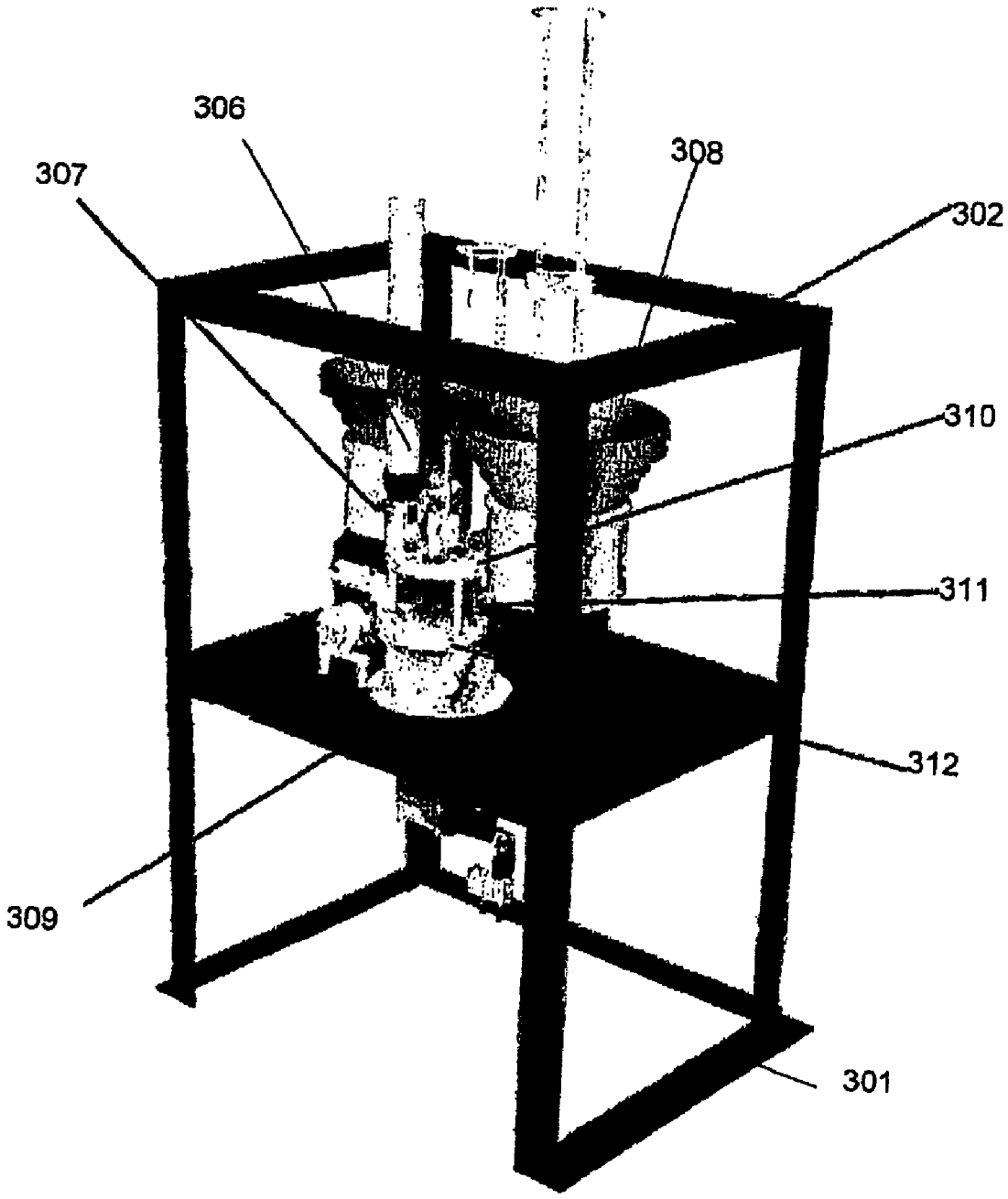
Figure 14:
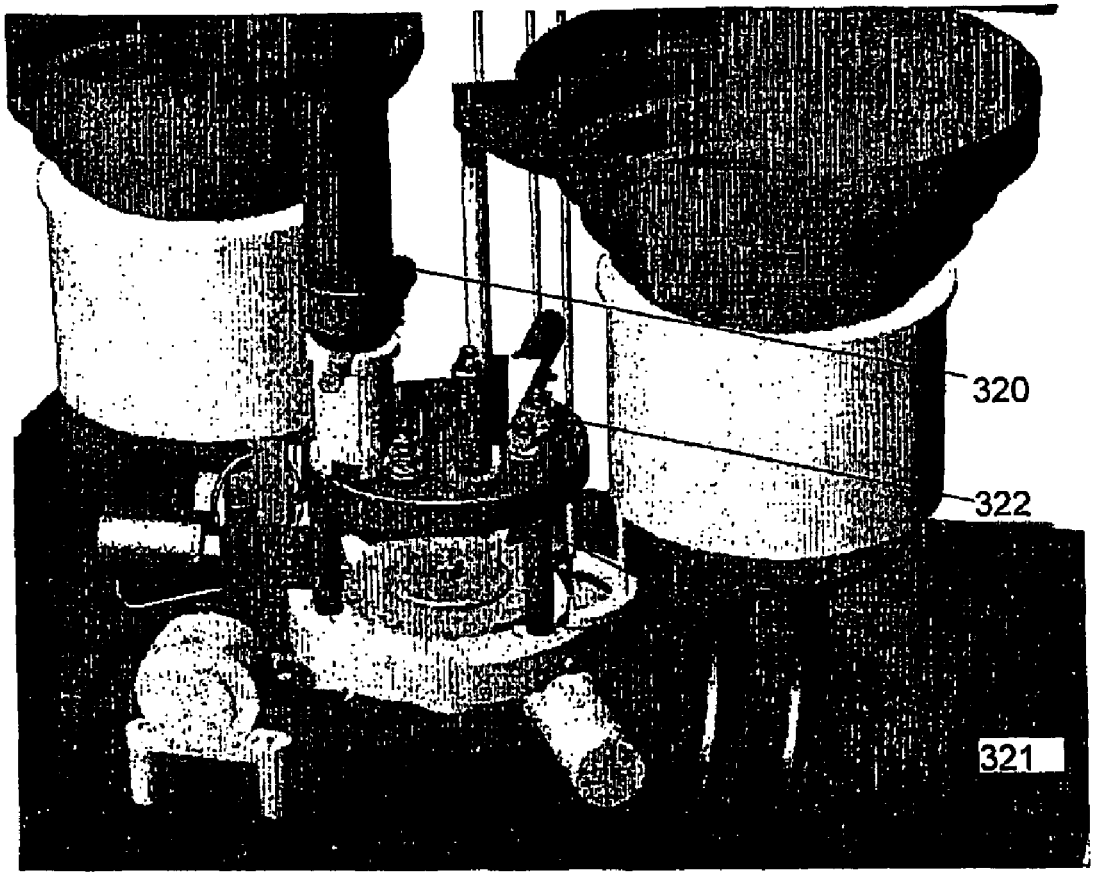
Figure 15:
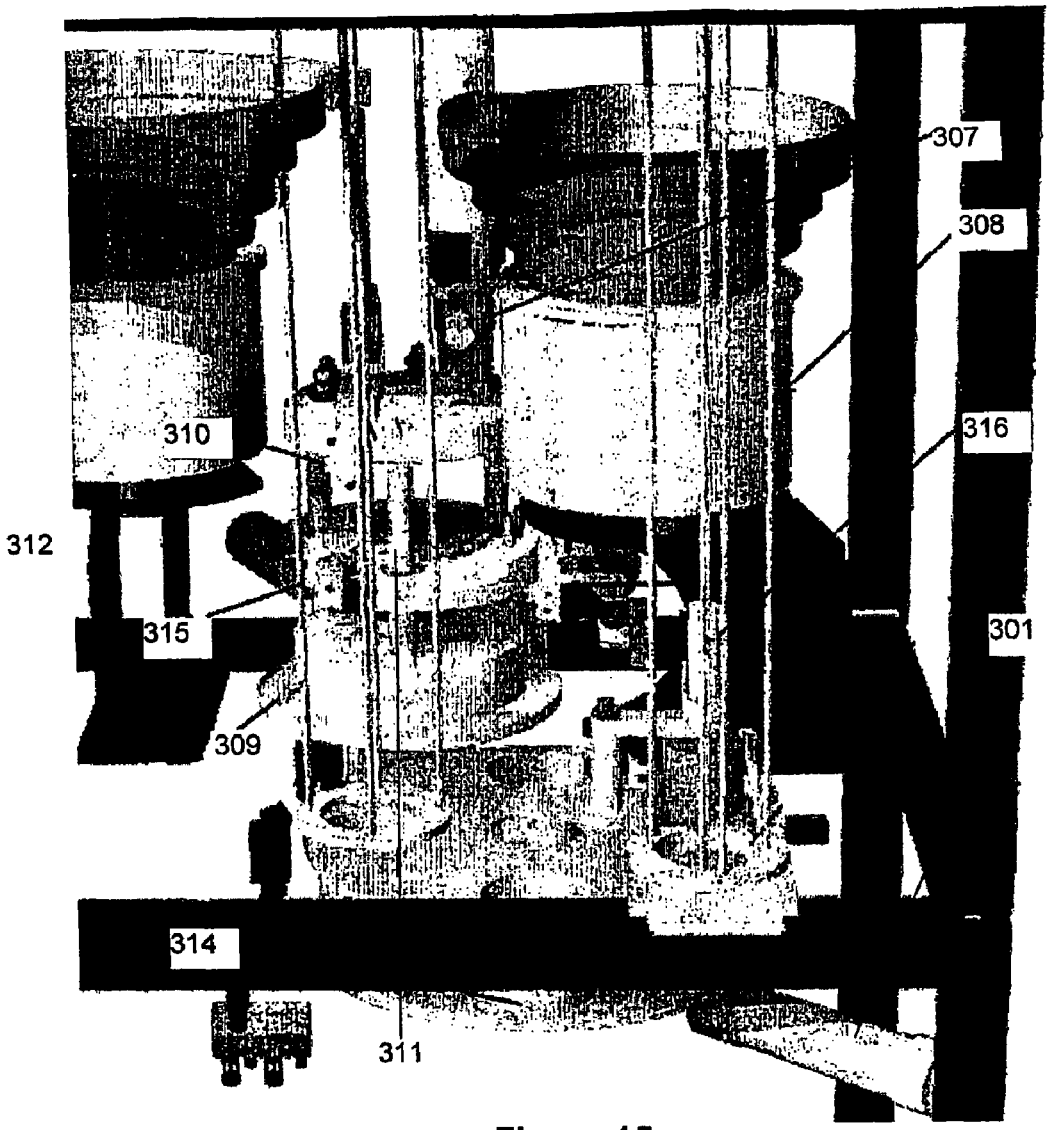
Figure 16:
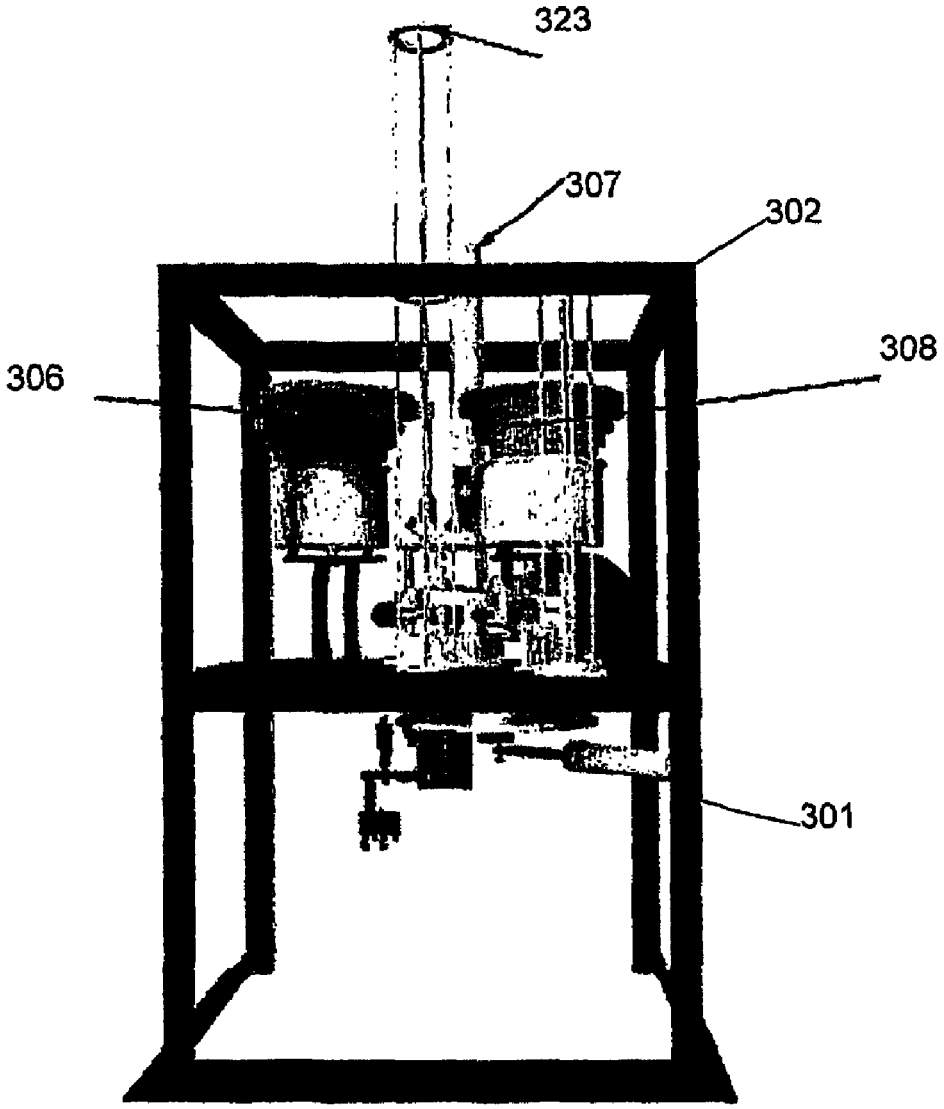
Figure 17:
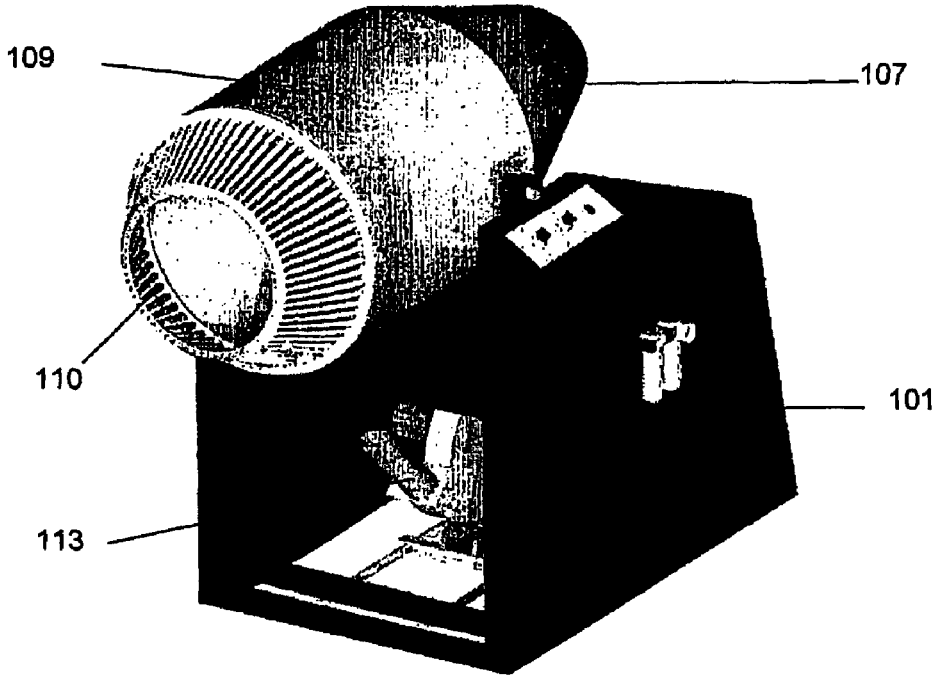
Figure 18:
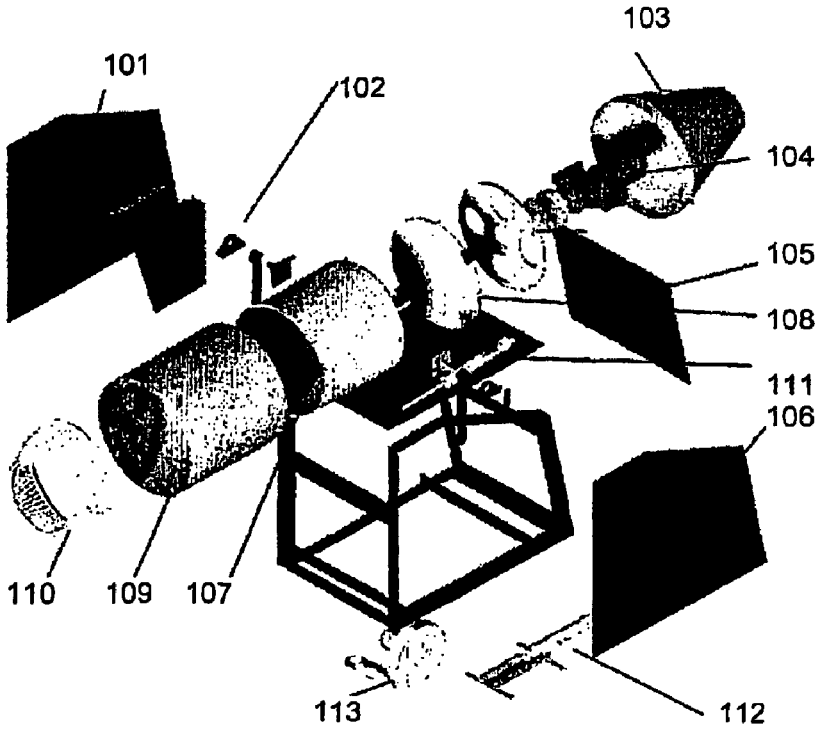

The present invention refers to an equipment for the recharge of firearms cartridges, and said equipment consists of four modules that can operate jointly or separately.

The invention originated from the need to cover the demand of the recharge of ammunitions in great amounts, accomplished at the barracks of the Military, Civil, and Federal Polices, and at the Brazilian Army, once the deflagrated cartridges have been recharged in manual operating equipments available in the national market.

The system of manual recharge of ammunitions executed in the available equipments is quite onerous, since that depends of a high number of specialized operators, besides the repetitive process that can cause lesions of repetitive effort (READ) to the operators.

For a better understanding, the following definitions will be used during the present report:

Cartridge-group composed of case, gunpowder (propellant element), bullet (projectile) and fuse;

Case—main lodging of a cartridge, usually made in metallic material, mainly, in brass alloy and capable to be reused when correctly handled;

bullets—projectile lodged in the case, usually made in metallic material, preferentially lead, which can have several state-of-the-art configurations and can be covered again by other materials;

Gunpowder—main propellant used in recharge of cartridges, and must be weighed with great acuity to guarantee the uniformity of the cartridge performance;

Fuse—element that begins the propellant burning process, and can have several configurations, such as boxer and berdan. For the effect of this report, it will always be considered the boxer type, unless expressly mentioned;

Recharge—reuse act of an empty case in good conditions, changing its fuse and adding gunpowder and bullet, adapting a new cartridge;

Calibration—the act of correcting possible deformations in a case, to guarantee its dimensional uniformity.

The recharge use in cartridges is practical widely adopted in armed forces and in shooting clubs spread worldwide, once this procedure reduces the cost drastically with cartridges, thus allowing a larger number of shots and, consequently, improving the user's training.

The recharge, now available in most of these places, and even with autonomous users, is done through a sequence of manual operations, through the use of manual equipments and of common sense on behalf of the responsible for the cartridge recharge, which causes a great variation in the quality of the final product obtained this way.

This manual recharge can be divided in the following stages:

$1^{st}$ Stage—consists of the calibration and removal of the fuse in the deflagrated cartridges that will be reused several times in the recharge. The operator manually puts a case at a time in the fastener of the press piston; and soon afterwards, he sets off a lever that makes the press piston go up and down, and in this movement the case passes through the calibrator and receives it;

$2^{nd}$ Stage: after the calibration of the cases, these are put in an electric finishing drum with a hexagonal format in which they are washed with degreasing products and steel spheres (or braziers), in that, with the rotation movement of the finishing drum with the cases and spheres inside the same, the cases are washed and polished.

$3^{rd}$ Stage: after the cases are washed, the same goes through the second press in which they are manually put in the case and the fuse, and the operator setting off the lever and the piston going up and down, and with this movement setting up the fuse in the case.

$4^{th}$ Stage: the fuse cases go to the third press in which they receive the opening of the mouth and the placement of the gunpowder.

$5^{th}$ Stage: the cases go to the fourth press in which they the projectile is manually set, and this being placed and set with the lever movement, thus concluding the cartridge recharge.

One of the several inconveniences of this process is the great demand of trained labor, once specialized operators are necessary for each of the different processing stages.

In the case of military organs and the protection of the population, the number of presses and operators is as big as the ammunition need that the barracks need to train them, removing this personal front line to a less noble task and of high cost.

Another problem found occurs in the second stage, when washing the cartridges, once the constant strokes between the cartridges and metallic grains provoke burrs and the crushing in the mouth of the cartridges, causing trouble in the finishing of the ammunition.

Additionally, there is the uniformity problem of the production, once the machines are handled by several different operators, and thus variation in the recharge procedure can occur. At this point there is still the problem regarding the gunpowder load added to each cartridge, once this can be superior to the capacity of the same, and can incur serious risks for the users.

The objective of the present invention, therefore, is to supply a group of automatic equipments that execute all the above tasks described with quality and in great volume, effortlessly and the operators training and that it fulfills the demand of the military corporations and civil clubs.

This objective is reached by a group of equipments totally automated to accomplish all tasks that compose the recharge of ammunitions of the calibers of central fire that range from caliber 32 to caliber 7.62×51 mm rifle.

This group of equipments is formed by three presses and a washing and cleaning system of cartridges, and said equipments can be integrated through automatic transport systems (that will be described here) or could be used in an isolated way.

The present invention will be understood better in the light of the enclosed illustrations, as mere example, and does not have limited nature, in which:

Illustration 1 is a perspective view of the calibration press;

Illustration 2 is a view in the calibration press cut;

Illustration 3 is another view in the calibration press cut off;

Illustration 4 is a perspective view of the calibration plate;

Illustration 5 is a perspective view of the driver mechanical group of the calibration plate;

Illustration 6 is a perspective view of the fuse press;

Illustration 7 is an internal perspective view of the fuse press;

Illustration 8 is a detailed view of the fuse press;

Illustration 9 is a detailed view of the fuse press;

Illustration 10 is another detailed view of the fuse press;

Illustration 11 is another detailed view of the fuse press;

Illustration 12 is a perspective view of the dosage press;

Illustration 13 is an internal perspective view of the dosage press;

Illustration 14 is another perspective view of the dosage press;

Illustration 15 is a detailed view of the dosage press;

Illustration 16 is an internal view perspective view of the dosage press;

Illustration 17 is a perspective view of the washing turbine of capsules; and Illustration 18 is an exploded perspective view of the washing turbine of capsules.

For a better understanding of the present invention, a separation of the recharge system will be made in four main elements:

- The calibrator press, which executes the first calibration operation and removal of the fuses of the deflagrated cartridges, which will be reused in the recharge several times;
- The fuse press that executes the assembly operation of the new fuses in the cartridges and it rejects the defective cartridges automatically;
- The dosage press that executes the ammunition assembly operation, in other words, it puts the gunpowder, the projectile, does the closing, counts and wraps the ammunition;
- The washing turbine that executes the wash and drying operations of the cartridges after the calibration, the cartridges are put in an electric drum with a hexagonal format in which are washed with a degreasing product and steel spheres or braziers, through the drum rotation movement.

All the presses work with feeders and automatic positioner of cartridges, fuses and projectiles, all conventional type ones.

The feeders used in the system described here are formed by an inferior base (34), preferentially of melted iron in which an electric reel is fixed (32) and torsion springs (33) with 150 degrees inclination, that transmit the vibration to the superior base (31), also preferentially in cast iron which is fixed to the positioned container (2), all with the same vibration principle with adjustment through potency dial, in that the container is adapted for each of the three presses. The containers (2) allow the cartridges, the fuses the projectiles to be positioned correctly in the spiral tracks that lead them up to the exit of the respective containers (2) where the transfer tubes are found (36), in its turn, they are connected to the pneumatic feeders (6) responsible for the placement of the referred items in the synchronized rotating disks of each of the respective presses.

Fuse Press:

The Press is the type of electropneumatic with automatic feeding as displayed in illustration 1 and has the function of calibrating the cases, removing the detonated fuses.

Its drive is made through electric motor-reducer (12), which can have varied potencies, linked to "V"-Belts (13), which rotate a cast iron steering wheel (14); with rotating cotter (15) that blocks the horizontal eccentric axle (10). The axle (10) is supported with bearings (11), preferentially of phosphorous bronze with constant automatic lubrication, and these being applied by seal retainers (26), which allow abundant lubrication without leaks.

In the extremity of the eccentric axles (10) a connecting rod is coupled (8), with tangency adjustment of the tools supported with ball bearings (16), and connected to the piston posts (17), which goes up and down supported in a cylindrical bearing (7), preferentially of vertical phosphorous bronze with constant lubrication and has seal retainers (26). This eccentric axle (10) moves the case so that the same runs into the calibrating tool (4), lodged in the tool posts (5), and this, at the same time, in that it calibrates, it removes the already deflagrated fuse of the case.

Linked to the bearings (7) of the piston tool holder (17) a plate is coupled (20) with the signaling pneumatic valves (19), driven by a synchronism cam (27) fixed to the bar guides (28), that sends the signs to the pneumatic signaling valves (19) that control the pneumatic cylinders of the disk spin, of the feeder of cases (6) and of the steering wheel blocking (18) of the eccentric axles (10).

The driven group is made in appropriate material, preferentially in the operation tools of operation of the calibrator with hard metal ring (carbide) rectified and polished, in VC131 steel plate Shell disk temperate with hard chrome bathe and a rotation table, piston and vertical bearings that compose the table group of the table, which are chrome-plated with hard chrome bath.

This press drive group of the press is fixed in an inferior modular structure (9) and has in its superior part a module (1) a rotation table (21) and an automatic feeding system of cases (6), as one can observe by illustration 3. The rotation table (21) is protected with a pneumatic component of high sensibility which cuts the movement of the piston if there is overload or synchronism lack.

The inferior modular structure is protected by a steel fairing enclosure (23) while the module (1) has doors with magnetic locks and transparent windows of great width in the four faces (24) which provides easy access for adjustments, assembly, cleaning etc.

On the module (1), a transparent silo is implanted (3) with great capacity for the placement of the cases to be calibrated. The same are transferred from the silo to the press through the vibratory system of continuous automatic positioning.

The press is fed by a conventional electric system, which has relay and circuit-breaker for overload protection, with on-off push buttons installed in the command panel, positioning vibratory system driver of cases, electric counter and module illumination (1) through installed fluorescent lights, everything with command panel driver.

The air compressed system is the conventional type and it has a preserving unit with adjustment gauntlet and reading manometer of the pressure installed. Starting from this the derivations through hoses and connections for the complete pneumatic system above described as follows.

The calibrated cases are directed and driven by tubes that go through the left lateral face of the inferior modular structure (9) and they are collected in a collection box (25) of great dimension with wheels that facilitate the displacement for the following phases. Alternatively to the collection box (25) one can install a rolling mat (not shown) to feed the cleaning turbine.

The detonated fuses are removed from the cartridges and directed through the tube that goes through the rear lateral face of the inferior modular structure (9) and they are collected in a collecting box (22) avoiding that the same ones are mixed with the calibrated cases.

The calibration of the 40-point caliber is made by passer-by system, which guarantees it a perfect calibration in all its extension. The SPL 38 caliber cases are calibrated by the conventional system entering and leaving in the calibration tool and directed to the other exit tube that transports them to the collecting box.

The press works in a simple way, with the cases being introduced in the container (2) of the vibrator (3) that feeds the feeder of cases (6). Once activating the press the cases are transferred by the feeder of cases (6) up to the rotation table (21) that maintains the case in vertical position. Through the motor-reducer group (12), belt (13) and eccentric axles (10), the piston tool posts (5) pushes the empty case against the calibrator (4) and, soon afterwards, returns it to the table, in that it is expelled form this one and it falls in the collection box of cases (25), while the fuse is collected by the vibratory movement of the table and it is sent to the fuse collecting box (22).

In normal conditions, a press as described above and using a conventional motor of 1 HP fed by 380 Volts three-phase conventional system is capable to calibrate up to five thousand cartridges per hour.

Washing Turbine:

The washing system cases were made in a way that steel spheres (or braziers) are not used to avoid the loss of cases that were crunched.

The system composes of a rotation nucleus (107) which has a textured rubber covering (109) with a subsequent closing (108). This nucleus is supported with bearings (102) that are supported in lateral and rear supports (101, 106) (105), adapting a rigid structure. This nucleus is connected to a motor-reducer (104) that in its turn has a covering (103). In its front part the rotation nucleus (107) has a nozzle (110) in conical format.

In its inferior part the system has a turbine of high pressure (113) for drying the cases. Both turbine (113) and the rotation nucleus (107) have a pneumatic inclinable system for its movement.

The rotation nucleus can be moved in angles that go from 90 to −90° degrees to facilitate the loading, washing and discharge processes, being activated by two pistons (111) of pneumatic drive. The turbine, in its turn, moves horizontally through a piston of single drive (112).

The wash procedure is simple and it constitutes in a first phase in the loading of the rotation nucleus (107) through the removal of the nozzle (110). Soon afterwards, the pistons are activated (111) that make the nucleus stop in the position of 300 degrees in the vertical sense during the washing period of the cases, the same ones being washed and polished with a solution of water and brightening degreasing.

Once you activate the motor (104), the nucleus (107) enters in a rotation movement to 60 rpm and thus causing the mixture to enter in movement with the cases, cleaning them. After the cleaning the quick cover clamp is put on the nozzle (110) and the nucleus search is made (107), allowing the exit of the dirty water for its subsequent treatment. After the emptying of the nucleus (107), a turbine of high pressure is activated (113) which leaves its withdrawal position inside the structure for the external part, through the pneumatic (112) and directing its mouth to the nozzle (110) which is found in rotation movement with cases, making the hot air dry the cases.

The turbine is fed by a conventional electric system, which has a relay and a circuit breaker for overload protection, with an on-off push button installed in the command panel. The system of compressed air is of the conventional type and it has a preserving unit with gauntlet adjustment and reading manometer of the pressure installed. Starting from this unit, they follow the derivations through hoses and connections for the complete pneumatic system described above.

Fuse Press:

The fuse press is the responsible device for the assembly of the new fuse in the case, having automatic rejection of the defective cases through cylinders pneumatic auxiliaries of high sensibility. The press fuse has pneumatic activator and it is has vertical, circular and lineal movements, all synchronized.

The press is constituted by an inferior (220) and superior structure (221), and this last one has doors with magnetic closures (222) and the inferior part has a metallic fairing enclosure (223). In the superior structure, the case feeder system (201) and the fuse reservoir feeder are kept (202). The case feeder system (201) is served continually through a silo (not shown) with great capacity of storage of cases.

The press has a generic format of "L" and on this structure; the main cylinder is set up (203). Tied the main stem of the cylinder (203) two cams are set (231) which in its turn activate the pneumatic signaling valves (206), which order the signals for the pilot valves that command all the pneumatic cylinders in synchronized continuous movements. The vertical (204) and horizontal cylinders (205) are responsible for the verification of the physical state of the case. These cylinders are projected on the rotation disk (208), and this is commanded by a transversal pneumatic cylinder (207) set up in the lateral face of the "L" base and linked the a safety clutch (236), that commands the synchronization of the rotation disk (208) with the main cylinder (203).

The operation of the press begins for the feeding of the cases through the positioning vibratory system (201) that positions and transports them to the transfer tube (234) that is set under the pneumatic feeder, (6) which in its turn puts a case in the rotation disk (208) at each synchronized cycle with the main cylinder (203).

The rejection of the split cases, with the face of the deformed mouth or wastes internally is executed by two interlinked pneumatic cylinders, a vertical (204) and horizontal one (205), and the vertical cylinder (204) has applied in the extremity of its stem, a specific component, for each desired caliber, that hampers the case externally and internally. Simultaneously a compressed air jet is provided inside the case. If the same presents a leak, the horizontal cylinder (205) receives the air expelled by the leak and it moves forward to reject it.

The rejection of the cases that present obstruction or deformation in the lodging pocket of the fuse is made through a horizontal pneumatic cylinder (205) which receives the advanced signal sent by a feeler pin (238) of high sensibility that penetrates at each cycle in the pocket and detects the obstruction, rejecting the case automatically.

Soon afterwards the fuses, put in an aleatoric way in the feeder (202), they enter in a rotation vibration movement and are driven and positioned in line in the exit track and in its turn is aligned with the transfer ramp (230), which receives them and drives them to the pin introducer (235). The pin introducer has its movement which goes up and down synchronized with the fuse pin (234) through the rocker arm (237) that interconnects them to the movement of the fuse pin and it is synchronized with the movement of the main pneumatic vertical cylinder (203), with fine adjustment through the thread and fixation nut (232), which allows total precision.

At each movement of the cylinder (203) a fuse is set up in the case and in its turn presented another one in the hole of the rotative disk (208) that transports it for the assembly position isolating it from the ones that are found in the transfer ramp (230) thus avoiding possible detonation accidents.

The fuse cases are expelled from the rotative disk (208) and driven through the tube that goes through the frontal face of the inferior block collected in a collection box (220) of great dimension with wheels that facilitate the displacement to the following phase. Alternatively, the collecting box (224) can install a rolling mat (not shown) for feeding the dosage press.

The fuse press is fed by a conventional electric system, which has a relay and circuit breaker for overload protection, with on-off push buttons installed in the command panel. The system of compressed air is the conventional type and that has a preserving unit with gauntlet adjustment and reading manometer of the pressure installed. Starting from this unit, they follow the derivations through hoses and connections for the complete pneumatic system described above.

Dosage Press

The dosage press is the responsible device for the assembly and final packing of the cartridges. The press has pneumatic activation and it is has vertical, circular and lineal movements, all synchronized. Its main cylinder (311) commands all the other auxiliary cylinders to guarantee the synchronization of the equipment. As example, a main cylinder of 100 m/m of Ø×125 m/m of course is capable to produce up to three thousand cartridges per hour.

The press is constituted by an inferior (301) and superior structure (302), and this last one has doors with magnetic closures (303) and the inferior part has a metallic fairing enclosure (304). In the superior structure all the press systems are kept, and the fuse feeding cases is continuing a container with great storage capacity of cases. The press is commanded through the panel (305) that has commands for control of the gunpowder dosage, and the optional interruption of automatic packing.

The superior structure has the automatic systems of feeding of cases in its interior (306) and the bullets (308) have a gunpowder-measuring device (307). The gunpowder measuring device (307) it a pneumatic activator commanded by the case, which, in the operation of the opening of the mouth, activates signaling valve that makes it act transferring the gunpowder dosage from the tank to the case. The gunpowder dosage is adjusted through a micrometric dial in the dosage bar, which in its turn; it is supported in anti-wear and auto-adjusted nylon sheets.

The press is formed by 2 bases, one inferior (309) and the other a superior one (310), linked amongst themselves by steel columns (311), and these are supported on the movable table (312), in cylindrical way and linked to the main cylinder (not shown), fixed to the inferior structure (301). The movement of the cylinder enables the movable table (312) to move, and this is tangent to the superior base (310) where the ammunition assembly tools are fixed (placement of the projectile and this press), the gunpowder measuring device (307), the feeder of cases (306), the feeder of bullets (308) and the safety and protection sensor as can observe better by illustration 14.

The safety and protection sensor are part of a safety system that marks the lack of cases, the lack or gunpowder excess, lack of bullet in the feeding and cartridge system. The enumerated lacks are detected by optic fiber sensors installed in the superior base (310), which send the lack of signals to the command panel or to the system computer that paralyzes the press in case problems are detected.

The movable table (312) it is supported on phosphorous bronze bases with constant lubrication and seal retainers, which guarantees it a smooth sliding, precise and stable. In the inferior part of the table (312), the turning system of the table is coupled (313), supported in bearings of spheres and connected to the stem of the main cylinder. In the superior part of the table (312), the turn disk is set up with nine stages. The turning of the disk is of pneumatic activation, synchronized, supported in the bronze table, which makes the disk turn a stage at each return movement. The tools that handle the case and the final cartridge are of hard metal (carbide), rectified and polished thus eliminating the waste in the cartridges provoked by the attrition.

The system of the automatic packing is composed by a spool (314), with central axis supported in bearings of spheres and contains 04 (four) lodging cavities for storage pots, the central axis being fixed in the inferior face of the base (309) of the inferior structure (301). Aligned with the cavities of the pots in the spool (314) the provisioning deposits (323), the pots and covers are fixed. Its pneumatic operation is commanded by the counter, when the same reaches a hundred units, it sends the advanced signal to the turning cylinder of the spool (315). The same makes the course and in the end, it activates a signaling valve that sends it to advance the positioning cylinder o the cover (316). When the cover reaches the position, the same cylinder (316) activates the signaling valve that advances the fixation vertical cylinder of the cover, which moves forward moves and returns. In its return, it sends the signal to return all the cylinders the position zero, waiting for the next pot to be filled, successively.

The first loading cycle of the machine should be made manually to allow the system to operate in all its capacity and it can be described by the following stages:

1st—the table (312) moves up and picks the first cartridge which will be introduced in the cocoon of the disk through the cylinder transporter when the table (312) completes its return;

2nd—the table (312) moves up and picks the second cartridge, in the return the disk gyrates in synchronism, the first cartridge being aligned with the gunpowder measuring device (307);

3rd—the table (312) moves up the first cartridge and activates the gunpowder measuring device (307), and this sends the gunpowder dosage to the first cartridge. The table (312) goes down and in the return; the disk rotates the first cartridge with gunpowder aligning with the checker;

4th—the table (312) moves up the first cartridge that has checked its dosage, the second cartridge is dosed, the table (312) goes down and in the return the disk gyrates, the first cartridge being aligned with the feeder of bullets (308);

5th—the table moves up the first cartridge and this one receives the bullet, and this one is put through the fixed pneumatic cylinder. The second cartridge checks the dosage of the gunpowder, the third cartridge receiving the dosage, the table (312) descends and the disk gyrating and the first cartridge being aligned with the existence checker and projectile fixation.

6th—the table moves up the first cartridge with the bullet and it is checked and fixed, the second receives the projectile, the third party checks the gunpowder and the fourth one receives the gunpowder. The table (312) descends the first cartridge that is aligned with the crimp.

7th—the table (312) arises and the first cartridge is crimped, fixing the projectile in the cartridge while all the other five cartridges in movement in the disk receive progressively what was described above. The table (312) descends, the disk gyrates and the first ammunition is completely set, being aligned in a neutral stage and it can be removed from the disk for millimetric and visual analysis, returning to the disk.

Soon afterwards, more two cycles manually are made until the first ammunition is in the position of disk exit. From this moment onwards, the counter is reduced to zero and start up is given in the continuous automatic system. With this, the press can be operated in three ways:

1—Manual operation cycle by cycle;

2—Continuous automatic operation;

3—Computerized operation in safety and protection system.

Rotating the pneumatic on-off push button, the set ammunition will be expelled from the disk and driven to the packing of plastic type pot that keeps it in the automatic packing system, which, when it receives a pre-determined number of units, it automatically advances a stage. Simultaneously it enters another pot to receive the following ammunitions, the first pot receiving the cover, and this one is put in the mouth of the pot automatically through the pneumatic cylinder synchronized that presses it.

In the following stage, the pot will be directed to the exit tube that drives it to the collecting box and so forth, and, when the collecting box is filled up, it will be removed and replaced by another one. The ammunition wrapped in the pots can be taken to a stock to be wrapped in secondary cardboard boxes. The packing type pot becomes more economical and efficient, because besides being practical, it protects the ammunition from humidity, shocks, breakings, etc. and said pots are also reused several times to keep the cartridges deflagrated that will return to the unit of recharge, where it will be reused.

If by any other reason the pots or covers finish up and the automatic packing is not possible, the press will continue producing usually directing the set ammunition, one by one, to the collecting box without the need of any adjustment.

The press is fed by a conventional electric system, which has a relay and a circuit breaker for overload protection, with on-off push buttons installed in the command panel, activating the vibratory system of the positioning of the cartridges, electric counter, the advanced and safety systems and the automatic packing system The system of compressed air is of the conventional type one and it has a preserving unit with gauntlet adjustment and reading manometer of the pressure installed. Starting from this unit, they follow the derivations through hoses and connections for the complete pneumatic system described above.

The system is made up of three working stations that can operate jointly or separately, and has characteristics that allow to set up several different systems that cope with each buyer's needs. For instance:

- three presses will individually be able to operate jointly, forming only one block of operational sequence, calibration, fusing and setting up the ammunition;
- the calibrated presses can operate separately or jointly in a separate room from the fusing and ammunition assembly;
- the presses can operate in line or in semicircle;
- the presses can be programmed to operate in a same speed and it auto feeds through systems of belts carriers, enabling the viable operation in large scale.

This last system is particularly interesting for fields of training of armed forces and policemen that generate great number of deflagrated cartridges.

With this system, the user obtains the following advantages in relation to the traditional manual systems:

- better reutilization of the material once its assembly does not depend of operators;
- greater reliability in the recharge, once it uniformizes the amount of gunpowder used in each cartridge;
- greater speed production once the equipments are automated;
- less hand labor use once they are few necessary operators.

The invention was described here in their general lines, but the substitution of the pneumatic and electric activation for other systems is understood inside of the scope herein.

The invention claimed is:

1. An apparatus for recharge of cartridges, comprising:

a) a calibrating press module, with a toolholder (5) having a calibrating tool (4) that calibrates and removes a deflagrated fuse from a case through movement of a piston toolholder (17), b) a washing turbine (113) module, comprising a rotative nucleus (107), that moves in angles that vary from 90 to −90° degrees around a transversal axis to facilitate loading, washing and discharge of the cases, which is activated by two pneumatic pistons (111), said turbine (113), moves horizontally through a single actuation piston (112);

c) a fuse press module, for fuse assembly in the case, with automatic rejection of defective cases through pneumatic auxiliary cylinders of high sensibility, said press comprising a case feeder system (201), a rotative disk (208) and a fuse reservoir feeder (202); and d) a dosage press module for assembly and packing of the cartridges, the dosage press moves in vertical, circular and linear synchronized movements, said dosage press having a main cylinder and is controlled by a panel (305) provided with commands for control of gunpowder dosage, and for the optional interruption of automatic packing, said dosage press formed by two bases, an inferior (309) and superior (310), linked by steel columns (311), and supported on a cylindrical movable table (312), and linked to the main cylinder fixed to the inferior structure (301).

2. The apparatus according to claim 1, wherein the calibrating module presses are powered by an electric motor-reducer group (12), linked to "V"-belts (13), that rotate a cast iron steering wheel (14), with rotative cotter (15) that blocks a horizontal eccentric axis (10), said axis (10) supported by bearings (11), and the eccentric axis (10) is coupled to a connecting rod (8), said connecting rod (8) is connected to the piston toolholder (17), which moves up, and is supported by a cylindrical bearing (7), said bearing (7) is coupled to a plate (20) with pneumatic signaling valves (19), activated by a synchronism cam (27), fixed to bar guides (28), said synchronism cam (27) sends signals to pneumatic signaling valves (19) which control a rotative table (21), that feed the cases (6) and that control the blocking by the steering wheel (18) of the eccentric axis (10).

3. The apparatus according to claim 1, wherein the activation group of the calibrating press is fixed in an inferior modular structure (9) with a superior module part (1); a rotative table (21) and an automatic case feeding system (6).

4. The apparatus according to claim 3, wherein the inferior modular structure (9) is protected by a steel fairing enclosure (23) and the superior modular structure (1) is protected by doors with magnetic locks and transparent windows (24).

5. The apparatus according to claim 1, wherein the washing turbine (113) has a rotative nucleus (107) with a covering of textured rubber (109), and its frontal part has a nozzle (110) in conical format and with a posterior closure (108).

6. The apparatus according to claim 5, wherein the rotative nucleus (107) is supported by bearings (102), that support lateral supports (101, 106), and a rear support (105), said nucleus (107) having a motor-reducer (104), with covering (103).

7. The apparatus according to claim 1, wherein the fuse press comprises an inferior (220) and a superior structure (221), said superior structure (221) with doors with magnetic closures (222) and the inferior structure (220) with a metallic fairing enclosure (223), said superior structure (221) houses the case feeder system (201) and the fuse reservoir feeder (202).

8. The apparatus according to claim 1 wherein the fuse press module has a generic format of "L" and on this structure is arranged a main cylinder (203) with cams (231) that activate pneumatic signaling valves (206), said pneumatic signaling valves (206) send the signals to pilot valves that command the pneumatic cylinders in a continuous and synchronized movement.

9. The apparatus according to claim 1 wherein the fuse press module has vertical (204) and horizontal cylinders (205) responsible for the verification of the physical state of the case, said cylinders (204, 205) being projected on the rotative disk (208), said rotative disk (208) controlled by a transversal pneumatic cylinder (207) set in a lateral face of the "L" base and linked to a safety clutch (236), that controls synchronization of the rotative disk (208) with the main cylinder (203).

10. The apparatus according to claim 1, wherein the fuse press module has a feeder (202), aligned with a transfer ramp (230), that drives the case to a pin introducer (235), said pin introducer (235) having a synchronized movement with a fuse pin (234) through a rocker arm (237) that is interconnected with the movement of the fuse pin and is synchronized with the movement of the main vertical pneumatic cylinder (203), with fine adjustment through the thread and fixation nut (232).

11. The apparatus according to claim 1, wherein the dosage press module is comprised by an inferior structure (301) and a superior structure (302), said superior structure (302) comprises doors with magnetic closures (303), and said inferior structure (301) comprises a metallic fairing enclosure (304) and panel (305).

12. The apparatus according to claim 11 wherein the superior structure (302) has automatic feeding systems for cases (306), bullets (308), and a gunpowder-measuring device (307).

13. The apparatus according to claim 12, wherein an inferior part of the table (312) is coupled to the turning system of the table (313), which is supported by spherical bearings and connected to the stem of the main cylinder, and a turn disk is set up on a superior part of the table (312).

14. The apparatus according to claim 13, wherein the automatic packing system is comprised by a spool (314), with central axis supported by spherical bearings and fixed in an inferior face of the base (309) of the inferior structure (301), and said spool (314) comprising lodging cavities.

15. The apparatus according to claim 1 wherein the modules are powered by an electric system, having a relay and a circuit-breaker for overload protection, with on-off push buttons installed in the command panel the modules further comprising a system of compressed air having a preserving unit with adjustment gauntlet and pressure manometer.

16. A process for recharging cartridges, comprising the steps of:

calibrating a case to be reused;

washing the case with degreasing mixtures;

changing a fuse of the case, verifying its physical integrity at the same time;

filling the case with a propellant;

thrusting a bullet in the case; wherein said process to be led by the apparatus of claim 1.

17. A cartridge recharged by the apparatus of claim 1.

18. A cartridge recharged by the process of claim 16.

* * * * *